United States Patent [19]

Spain et al.

[11] 4,385,704

[45] May 31, 1983

[54] CRANE BOOM TOP PLATE LATERAL SUPPORT

[75] Inventors: Stanley R. Spain, Waynesboro, Pa.; William G. Reichard, Columbia, S.C.

[73] Assignee: Kidde, Inc., Clifton, N.J.

[21] Appl. No.: 178,372

[22] Filed: Aug. 14, 1980

[51] Int. Cl.[3] ..... B66C 23/04

[52] U.S. Cl. ..... 212/269; 52/118; 308/3 R

[58] Field of Search ..... 212/230, 231, 264, 267–269; 52/115, 118, 632; 308/3 R

[56] References Cited

U.S. PATENT DOCUMENTS 3,419,157 12/1968 Brady ..... 212/268
3,719,403 3/1973 Sung ..... 212/269 X
4,004,695 1/1977 Hockensmith et al. ..... 212/269
4,045,936 9/1977 Sterner ..... 52/118 X

*Primary Examiner*—Robert G. Sheridan
*Attorney, Agent, or Firm*—Brady, O'Boyle & Gates

[57] ABSTRACT

To resist side deflection and buckling of the top and side plates in larger size multi-section telescopic crane booms, top plate lateral supports for the movable boom sections in the fully extended and fully retracted critical zones are provided to supplement the action of bottom lateral wear pads. The top plate lateral supports include adjustable spring bars on the sides and forward ends of the boom sections and coacting cam pads on the top plates of the boom sections at their forward ends and in the socketing zones when the boom sections are fully extended.

10 Claims, 8 Drawing Figures

CRANE BOOM TOP PLATE LATERAL SUPPORT

BACKGROUND OF THE INVENTION

The development of ever-larger multi-section telescopic crane booms has created structural and operational problems which have not existed in comparatively smaller crane booms of lesser load lifting capacities. Among these problems is an increased tendency for the extended boom to deflect laterally due to stresses caused by a supported swinging load, as when the boom is in a sluing mode. There is also an increased tendency for buckling of the side and top plates of the boom sections due to twisting stresses including those induced by the weight and the rigging of a side stowable jib for the multi-section boom.

It is the object of the present invention to deal effectively, economically and practically with these problems through the provision of lateral supports for the top plates of movable boom sections in both their fully retracted and fully extended positions, which are the only positions of use in the largest sizes of multi-section booms.

The provided lateral supports are active only when the boom sections are fully retracted and fully extended. In the latter case, the supports are active in the critical socketing zone between adjacent boom sections. The supports are individually adjustable to regulate the lateral clearance between adjacent boom sections. The supports form a spacing mechanism which augments the action of the customary bottom lateral wear pads on booms of this character.

The bottom lateral wear pads support the rears of the extended boom sections, but heretofore in the prior art nothing has been provided to restrict lateral play at the tops of the boom sections in the socketing area. The present invention effectively restricts this top lateral movement or play at the front of the socketing area to prevent side deflection or buckling, as stated.

Other features and advantages of the invention will become apparent during the course of the following detailed description.

DETAILED DESCRIPTION

Figure 4:
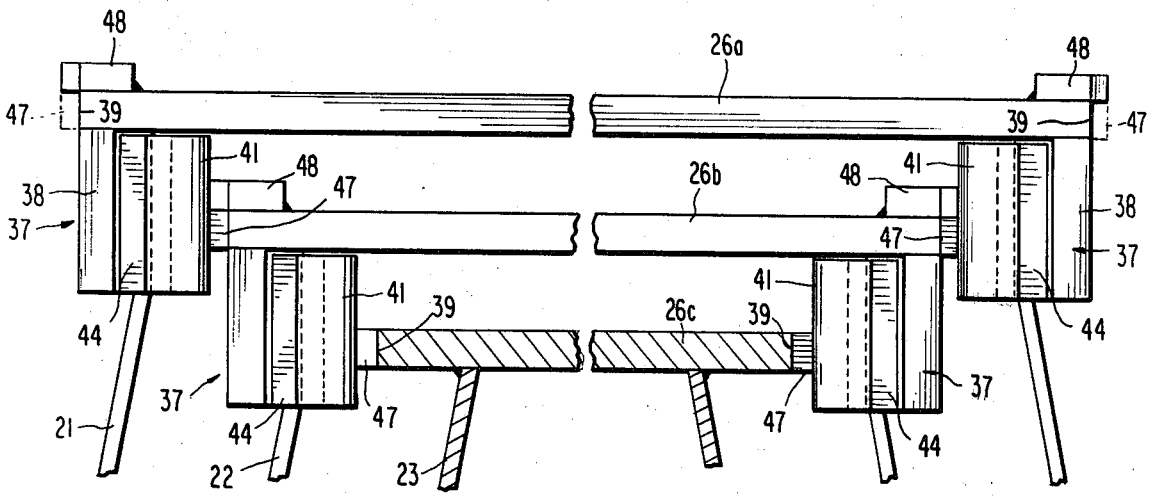
FIG. 4 is an enlarged fragmentary transverse vertical section taken on line 4—4 of FIG. 3.
Figure 5:
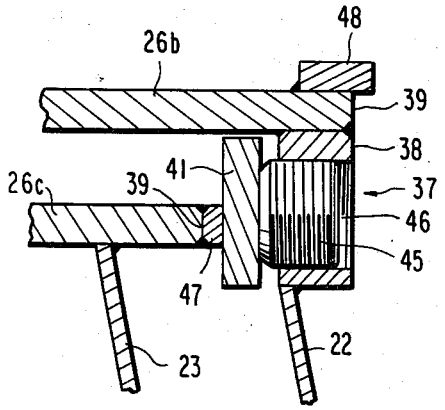
FIG. 5 is a similar fragmentary section taken on line 5—5 of FIG. 3.
Figure 6:
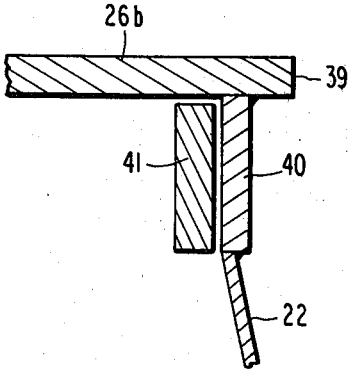
FIG. 6 is a similar view taken on line 6—6 of FIG. 3.

Referring to the drawings in detail wherein like numerals designate like parts, a large capacity five section telescopic crane boom is illustrated wherein all of the boom sections are trapezoidal in cross section as best indicated by FIG. 4. The boom includes a base section 20, inner mid-section 21, center mid-section 22, outer mid-section 23 and a fly section 24 having a nose block 25. The number of boom sections and their sizes may be varied. Each section of the boom includes a flat top plate 26, **26*a*, 26*b*, 26*c* and 26*d***, parallel flat bottom plates and downwardly diverging symmetrical side plates or walls, as illustrated in accordance with known practice.

The boom base section 20 is pivotally attached as at 27 to a support structure 28 on the turntable 29 of a suitable crane carrier. Power cylinders 30 are coupled between the support structure 28 and an intermediate bracket means 31 on the bottom of the base section 20 for raising and lowering the boom around the axis of pivot 27.

The boom is of a type in which a single hydraulic cylinder 32 having its rod 33 anchored within the base section 20 is employed to fully extend and fully retract selectively the individual movable boom sections to create a boom of the necessary configuration. The cylinder 32 operates in cooperation with a boom movable section locking or pinning assembly 34 fixed to the forward end portion of the base section 20, FIG. 1. The arrangement enables the secure locking of each movable boom section in a fully retracted and in a fully extended position.

In the regions of front reinforcing collars 35, **35*a*, 35*b*, etc. on the movable boom sections, the customary bottom lateral wears pads 36 are provided which restrict lateral movements of the bottom plates of the several movable boom sections but cannot restrict comparable movements of the top plates 26*a* and 26*d***.

Figure 1:
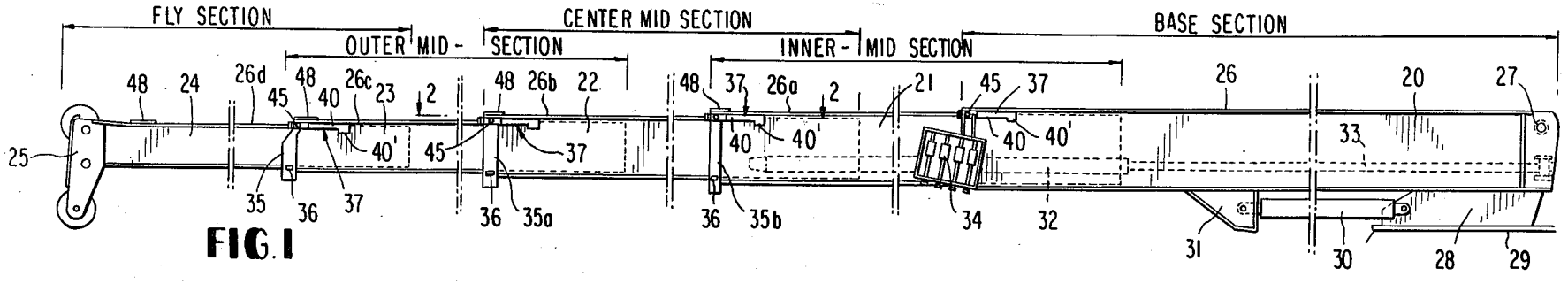
FIG. 1 is a side elevation of a crane boom equipped with top plate lateral supports in accordance with the invention, parts broken away.

Top plate supports 37, FIG. 1, for the several movable boom sections are provided on the opposite sides of the boom sections 20, 21, 22 and 23 at their forward ends. These lateral supports for top plates **26*a* . . . 26*d* form the main subject matter of the present invention. The details of the top plate lateral supports are illustrated in FIGS. 2 through 7**.

Figure 2:
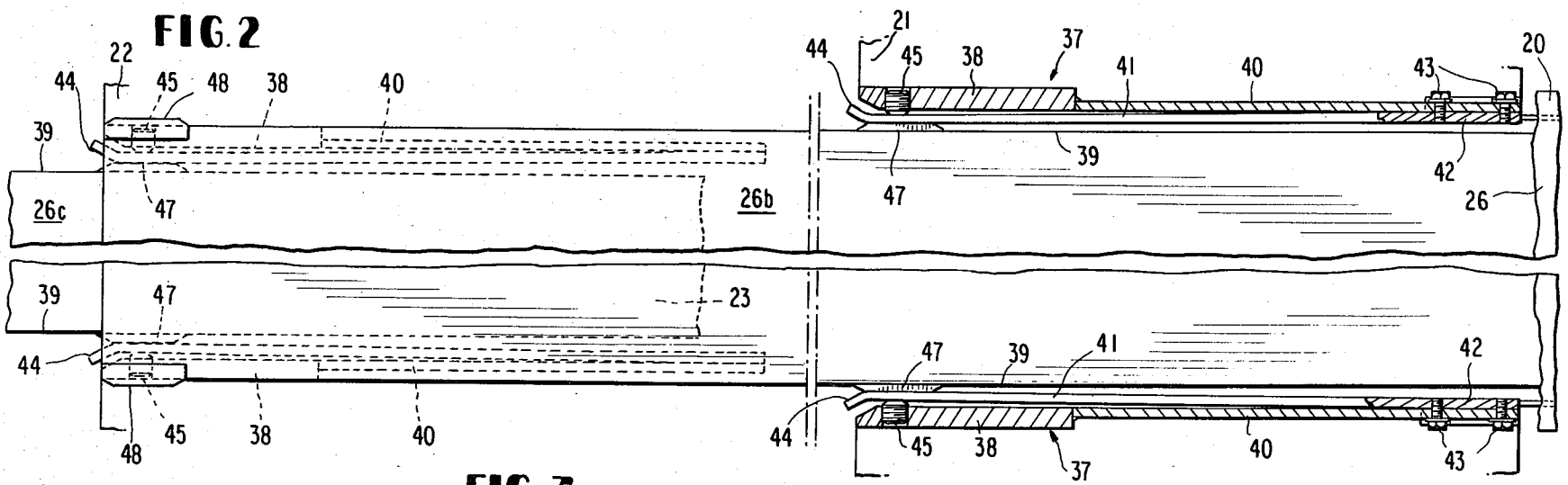
FIG. 2 is an enlarged fragmentary plan view of the boom, partly in horizontal section, taken on line 2—2 of FIG. 1.
Figure 3:
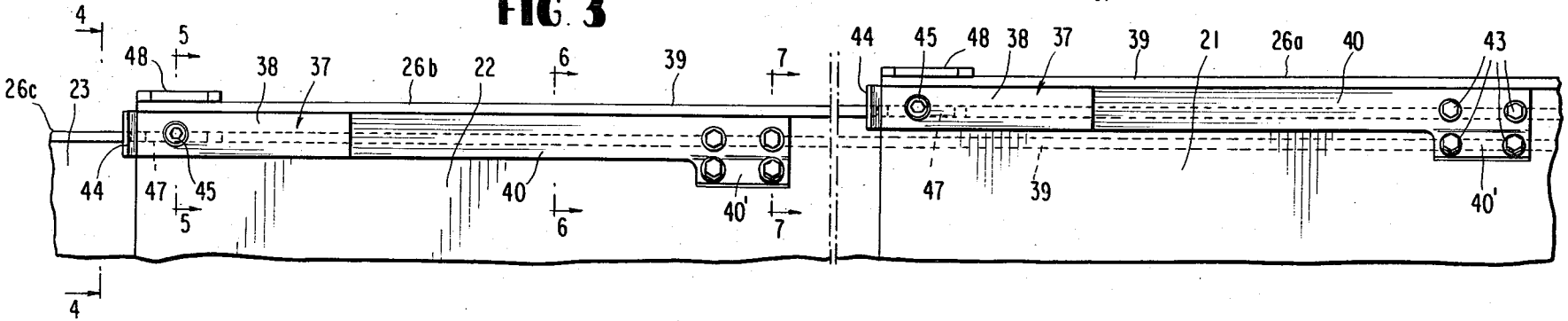
FIG. 3 is a fragmentary side elevation of the boom structure in FIG. 2 on the same scale as FIG. 2.

Each assembly 37 comprises a relatively thick spring adjustment block 38 welded within a cut-out in the adjacent side plate of each boom section 20 . . . 23. The block 38 is not provided on the boom fly section 24. It is provided on each side of the other boom sections as shown in FIG. 2. The cut-out for the block 38 is immediately below the top plate 26 . . . **26*c*, FIG. 5, and the block is also welded to the bottom of the projecting edge portion of each boom section top plate so as to be flush with the adjacent longitudinal edge 39 of the top plate. Rearwardly of the block 38 a somewhat reduced thickness vertical spring bar mounting plate extension 40 is also installed and welded in the side plate cut-out and also welded to the rear of block 38 to form an integral rigid structure. At its rearward end, the mounting plate extension 40, FIG. 7, has an inclined depending part 40' formed integrally therewith. The parts 40' are also shown clearly in FIG. 3**.

Figure 7:
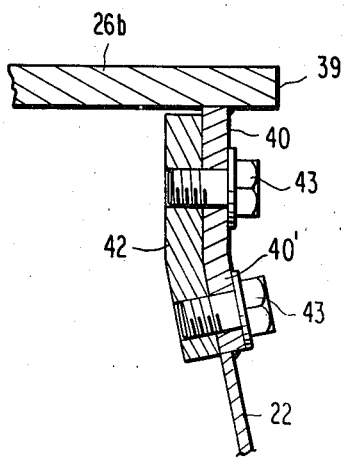
FIG. 7 is a similar view taken on line 7—7 of FIG. 3.

Immediately inwardly of blocks 38 and plate extensions 40 are lateral leaf spring bars 41 whose rearward terminals 42 are shaped to lie on the inner surfaces of elements 40 and 40', FIG. 7. These rearward terminals 42 are anchored rigidly to the inner faces of elements 40 and 40' by screws 43. The spring bars 41 are substantially coextensive lengthwise with blocks 38 and plate extensions 40 and have their free forward terminals 44 angled outwardly to provide deflection surfaces on the spring bars 41. The elongated spring bars are cantilevered forwardly of their anchoring screws 43 and are laterally movable in horizontal planes relative to the longitudinal edges of the adjacent boom section top plates.

Lateral adjusting screws 45 for the leading ends of spring bars 41 are mounted in threaded openings 46 of the blocks 38 near the forward ends of these blocks. The tension of the spring bars 41 causes them to bear against the inner ends of the adjusting screws.

Figure 8:
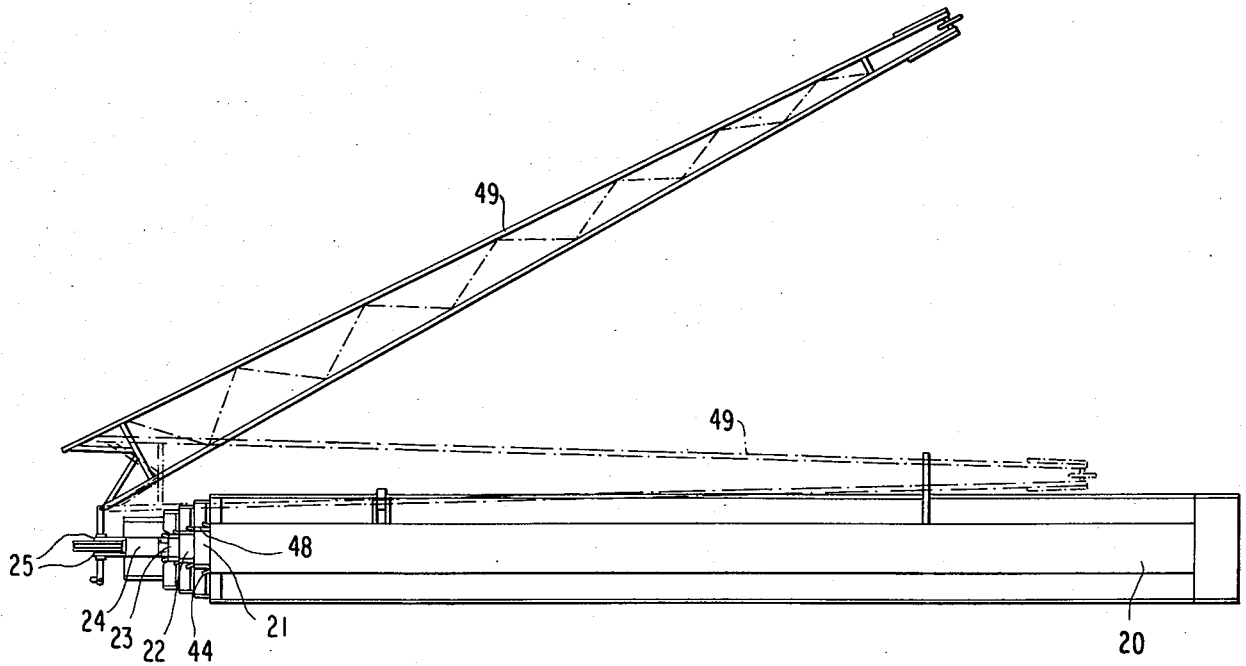
FIG. 8 is a plan view of the boom in a fully retracted state showing the side stowable jib.

First cam pads 47 are welded to the longitudinal edges 39 of the top plates *26a* . . . *26d* and engage the interior faces of the spring bars 41 immediately rearwardly of their angled terminals 44 at the forward ends of the socketing areas between the several sections of the boom, when the boom is in a fully extended mode as shown by the drawings, with the exception of FIG. 8, which shows the boom in a fully retracted state.

Second cam pads or plates 48 are welded to the top plates *26a* . . . *26d* and project outwardly of the longitudinal edges 39 equidistantly with the projections of the first cam pads 47 in the socketing areas. When the movable boom sections or selected ones of them are fully retracted within adjacent boom sections by operation of the single cylinder 32, the second cam pads 48 will engage and cam outwardly the deflector terminals 44 of spring bars 41 and occupy the same relative positions occupied by the first cam pads 47 when a boom section or sections are fully extended. When the first pads 47 are fully retracted, they move out of engagement with the spring bars 41 which are laterally angled relative to the elements 38 and 40 and the top plate edges 39, FIG. 2. When the second cam pads 48 are fully extended forwardly with their respective boom sections, they are, of course, disengaged from the spring bars 41. Thus, it may be seen that the spring bars 41 are engaged only with the respective pads 47 and 48 at the forward end portions of the spring bars when the boom sections are fully extended and fully retracted and there are no intermediate points or areas of engagement. This operation is consistent with the fact that the several movable sections of the boom operated by the cylinder 32 are used only in fully extended or fully retracted positions, and not in any intermediate positions.

It might be mentioned that in the manufacturing process, to maintain the desired dimensional tolerances, it is advantageous to first install the cam pads 47 on the top plate edges 39 and to install and adjust the spring bars 41 by use of the adjusting screws 45 to establish the desired clearances with the boom fully extended. Following this, the boom sections are fully retracted and without changing the spring bar adjustments the second cam pads 48 are positioned and welded on the top faces of plates *26a* . . . *26d*.

FIG. 8 shows the telescopic boom in the fully retracted state where the second cam pads 48 are actively engaged with adjustable spring bars 41 and the first cam pads 47 are inactive relative to the spring bars. A side stowable jib 49 for the crane boom is shown in the stowed position in phantom lines and in full lines is in the process of being swung forwardly to the use position ahead of the fly section 24. This jib exerts a twisting stress on the boom sections tending to produce buckling of their side and top plates primarily. The top plate supports 37 resist this buckling, as they also resist side deflection of the boom, thus strengthening it in two ways, thereby actually increasing its safe lifting capacity. In effect, the adjustable top plate lateral supports are a spacing mechanism between boom sections in the socketing zones when the sections are fully extended and at the fronts of the several sections when they are fully retracted. This lateral clearance can be adjusted through the screws 45 with precision.

The provision of the cam pads 47 and 48 also eliminates sliding contact between the raw edges 39 of the boom section top plates and the spring bars 41, thus reducing friction and wear. The adjustability of the supports 37 compensates for inevitable variations in the lateral fit of adjacent boom sections as they are manufactured. In short, the invention materially improves the efficiency of operation of the large multi-section boom, extends its life and contributes to its load lifting ability.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. In a multi-section telescopic crane boom of the type in which the movable boom sections are either fully extended or fully retracted during use, the respective boom sections having bottom lateral wear pads between them and having top and side plates which are subject to buckling stresses as well as lateral deflection during use, the improvement which comprises adjustable lateral supports for the top plates of the movable boom sections enabling the lateral clearances between the boom sections adjacent to their top plates to be finely regulated, said adjustable lateral supports being arranged in pairs on opposite sides of the boom sections near their forward ends, each lateral support comprising a longitudinally cantilevered spring bar disposed between an adjacent top plate longitudinal edge and a side wall lateral adjustment element outwardly of a free end portion of the spring bar.

2. In a multi-section telescopic crane boom as defined in claim 1, and said adjustment element comprising a lateral axis adjustment screw bearing on the exterior side of said spring bar near its free end.

3. In a multi-section telescopic crane boom as defined in claim 2, and each lateral support further comprising a first and a second spring bar camming pad fixed in longitudinally spaced relationship to a boom section top plate and projecting outwardly of the longitudinal edge of the top plate for engagement with the interior side of the spring bar near its free end only, the first camming pad engaging the spring bar when the boom is fully extended and the second camming pad engaging the spring bar when the boom is fully retracted.

4. In a multi-section telescopic crane boom as defined in claim 3, and a laterally inclined deflector terminal on the forward end of each spring bar enabling it to ride smoothly into engagement with the second camming pad.

5. In a multi-section telescopic crane boom as defined in claim 3, and an insert block having a threaded opening for said adjustment screw and being fixed to the adjacent boom section side wall outwardly of the spring bar,

6. In a multi-section telescopic crane boom as defined in claim 5, and an insert plate extension fixed to said block and side wall and extending rearwardly of the block to a location adjacent to the rear end of the spring bar, and anchoring fasteners for the rear end of the spring bar engaged in the spring bar and said plate extension.

7. In a multi-section telescopic crane boom as defined in claim 1, and rear end anchoring means for said spring bar secured to a side wall of an adjacent boom section lying outwardly of the spring bar.

8. In a multi-section telescopic crane boom as defined in claim 1, and each lateral support additionally comprising first and second longitudinally spaced camming pads fixed to said top plate and each being separately engageable with a leading end portion of the spring bar when the boom is fully extended and fully retracted respectively.

9. In a multi-section telescopic crane boom as defined in claim 1, and said lateral supports being positioned in boom section side wall cut-outs immediately below the top plates of the boom sections.

10. In a multi-section telescopic crane boom of the type in which the movable boom sections are either fully extended or fully retracted during use, the respective boom sections having bottom lateral wear pads between them and having top and side plates which are subject to buckling stresses as well as lateral deflection during use, the improvement comprising, longitudinally extending lateral supports, arranged in pairs on opposite sides of the boom sections near their forward ends, one end of each lateral support being fixed to a boom section, adjustment means being positioned at the free end of each lateral support, said supports being laterally angled relative to the top plate edges, a first and second pad fixed in longitudinally spaced relationship to a boom section top plate selective engagement with the interior side of the lateral support, the first pad engaging the lateral support when the boom is fully extended and the second pad engaging the lateral support when the boom is fully retracted.

* * * * *